US007644821B2

(12) United States Patent
Perell

(10) Patent No.: US 7,644,821 B2
(45) Date of Patent: Jan. 12, 2010

(54) SEALED PRODUCT DELIVERY UNIT WITH RUPTURING PUMP

(75) Inventor: William S. Perell, San Francisco, CA (US)

(73) Assignee: PopPack, LLC, San Francisco, CA (US)

( * ) Notice: Subject to any disclaimer, the term of this patent is extended or adjusted under 35 U.S.C. 154(b) by 402 days.

(21) Appl. No.: 11/731,705

(22) Filed: Apr. 2, 2007

(65) Prior Publication Data

US 2007/0241024 A1 Oct. 18, 2007

Related U.S. Application Data

(60) Provisional application No. 60/790,483, filed on Apr. 10, 2006.

(51) Int. Cl.
*B65D 83/04* (2006.01)
*B65D 73/00* (2006.01)

(52) U.S. Cl. ..... 206/532; 206/469; 206/530

(58) Field of Classification Search ..... 206/528, 206/530, 531, 532, 534.1, 534.2, 462, 469, 206/484; 222/92; 383/906
See application file for complete search history.

(56) References Cited

U.S. PATENT DOCUMENTS

| | | | |
|---|---|---|---|
| 3,074,544 | A | 1/1963 | Bollmeier et al. |
| 3,189,227 | A | 6/1965 | Hobbs et al. |
| 3,256,981 | A | 6/1966 | Kurtz |
| 3,294,227 | A | 12/1966 | Schneider et al. |
| 3,301,390 | A | 1/1967 | Via, Jr. |
| 3,573,069 | A | 3/1971 | Keller et al. |
| 3,608,709 | A | 9/1971 | Pike |

(Continued)

FOREIGN PATENT DOCUMENTS

| | | |
|---|---|---|
| DE | 20314741 | 1/2004 |

(Continued)

OTHER PUBLICATIONS

International Search Report for International Application No. PCT/EP2007/053475 mailed Jun. 12, 2007.

*Primary Examiner*—Stephen Garbe
*Assistant Examiner*—Dene Quest
(74) *Attorney, Agent, or Firm*—Dority & Manning, P.A.

(57) ABSTRACT

Sealed delivery unit 10 (shown in exploded format in FIG. 1A) contains medication 10M, and is formed by a generally flat member 10F pressed into selective engagement with an opposed shaped member 10S. Pumping chamber 12P, enclosed between the members generates a rupturing pressure in response to an external force applied by the user (indicated by arrow F shown in FIG. 1B). Enclosed Medication chamber 12M contains the medication to be delivered. Tunnel conduit 14 provides fluid communication between the chambers for rupturing the medication chamber in response to the rupturing pressure. Perimeter seal 16 extends around the pumping chamber and the medication chamber and the tunnel conduit. The perimeter seal is secure enough to withstand the internal rupturing pressure generated during delivery. Delivery port 18 with pull-away closure 18C (see FIG. 1C) delivers the medication out of medication chamber 12M. Rupture site 18S is proximate the delivery port. Rupture flap 18F produced by the rupturing at the rupture site, is connected to the pull-away closure. The flap projects outward permitting the user to grasp the pull-away the closure and open the delivery port for delivery of the medication.

20 Claims, 2 Drawing Sheets

U.S. PATENT DOCUMENTS

| | | | |
|---|---|---|---|
| 3,635,376 | A | 1/1972 | Hellstrom |
| 3,921,805 | A | 11/1975 | Compere |
| 4,275,840 | A | 6/1981 | Staar |
| 4,301,923 | A | 11/1981 | Vuorento |
| 4,402,402 | A | 9/1983 | Pike |
| 4,511,052 | A | 4/1985 | Klein et al. |
| D279,808 | S | 7/1985 | Pharo |
| 4,540,089 | A | 9/1985 | Maloney |
| 4,597,244 | A | 7/1986 | Pharo |
| 4,610,684 | A | 9/1986 | Knox et al. |
| 4,632,244 | A | 12/1986 | Landau |
| 4,704,314 | A | 11/1987 | Hsu et al. |
| 4,711,359 | A | 12/1987 | White et al. |
| 4,759,472 | A | 7/1988 | Strenger |
| 4,793,123 | A | 12/1988 | Pharo |
| 4,798,288 | A | 1/1989 | Holzner |
| 4,872,556 | A | 10/1989 | Farmer |
| 4,872,558 | A | 10/1989 | Pharo |
| 4,874,093 | A | 10/1989 | Pharo |
| 4,890,744 | A | 1/1990 | Lane, Jr. et al. |
| 4,918,904 | A | 4/1990 | Pharo |
| 4,949,530 | A | 8/1990 | Pharo |
| 4,961,495 | A | 10/1990 | Yoshida et al. |
| 5,050,736 | A | 9/1991 | Griesbach et al. |
| 5,100,028 | A | 3/1992 | Seifert |
| 5,114,004 | A | 5/1992 | Isono et al. |
| 5,126,070 | A | 6/1992 | Leifheit et al. |
| 5,207,320 | A | 5/1993 | Allen |
| 5,215,221 | A | 6/1993 | Dirksing |
| 5,272,856 | A | 12/1993 | Pharo |
| 5,325,968 | A | 7/1994 | Sowden |
| 5,373,966 | A | 12/1994 | O'Reilly et al. |
| 5,427,830 | A | 6/1995 | Pharo |
| 5,445,274 | A | 8/1995 | Pharo |
| 5,447,235 | A | 9/1995 | Pharo |
| 5,487,470 | A | 1/1996 | Pharo |
| 5,492,219 | A | 2/1996 | Stupar |
| 5,588,532 | A | 12/1996 | Pharo |
| D386,074 | S | 11/1997 | Pharo |
| 5,711,691 | A | 1/1998 | Damask et al. |
| 5,775,491 | A | 7/1998 | Taniyama |
| 5,792,213 | A | 8/1998 | Bowen |
| 5,814,159 | A | 9/1998 | Paley et al. |
| 5,865,309 | A | 2/1999 | Futagawa et al. |
| 5,870,884 | A | 2/1999 | Pike |
| 5,910,138 | A | 6/1999 | Sperko et al. |
| 5,928,213 | A | 7/1999 | Barney et al. |
| 5,944,709 | A | 8/1999 | Barney et al. |
| 5,967,308 | A | 10/1999 | Bowen |
| 6,001,187 | A | 12/1999 | Paley et al. |
| 6,007,264 | A | 12/1999 | Koptis |
| 6,036,004 | A | 3/2000 | Bowen |
| 6,068,820 | A | 5/2000 | De Guzman |
| 6,165,161 | A | 12/2000 | York et al. |
| 6,198,106 | B1 | 3/2001 | Barney et al. |
| 6,203,535 | B1 | 3/2001 | Barney et al. |
| 6,443,152 | B1 * | 9/2002 | Lockhart et al. ..... 128/203.21 |
| 6,468,377 | B1 | 10/2002 | Sperko et al. |
| 6,491,652 | B1 | 12/2002 | Hata |
| 6,547,468 | B2 | 4/2003 | Gruenbacher et al. |
| 6,722,364 | B2 * | 4/2004 | Connelly et al. ..... 128/203.15 |
| 6,726,364 | B2 | 4/2004 | Perell |
| 6,846,305 | B2 | 1/2005 | Smith et al. |
| 6,935,492 | B1 | 8/2005 | Loeb |
| 6,968,952 | B2 | 11/2005 | Crevier et al. |
| 6,996,951 | B2 | 2/2006 | Smith et al. |
| 7,040,483 | B2 * | 5/2006 | Inuzuka et al. ..... 206/219 |
| 7,051,879 | B2 | 5/2006 | Ramet |
| 7,055,683 | B2 | 6/2006 | Bourque et al. |
| 7,175,614 | B2 | 2/2007 | Gollier et al. |
| 7,306,095 | B1 | 12/2007 | Bourque et al. |
| 2002/0150658 | A1 | 10/2002 | Morrissette et al. |
| 2002/0170832 | A1 | 11/2002 | Klair |
| 2003/0019781 | A1 | 1/2003 | Kocher |
| 2004/0057638 | A1 | 3/2004 | Perell et al. |
| 2004/0226848 | A1 | 11/2004 | Dunn-Rankin |
| 2006/0023976 | A1 | 2/2006 | Alvater et al. |
| 2006/0126970 | A1 | 9/2006 | Perell |

FOREIGN PATENT DOCUMENTS

| | | | |
|---|---|---|---|
| EP | 00306207 | A1 | 3/1989 |
| EP | 00317130 | A1 | 5/1989 |
| FR | 2345363 | A1 | 10/1977 |
| GB | 2253605 | A | 9/1992 |
| JP | 04215927 | A | 8/1992 |
| JP | 11029176 | A | 2/1999 |
| JP | 2000255598 | A | 9/2000 |
| WO | WO 96/23700 | | 8/1996 |
| WO | WO 02/083504 | A1 | 10/2002 |
| WO | WO 2004/100856 | A2 | 11/2004 |
| WO | WO 2005/022323 | A | 3/2005 |
| WO | WO 2005/077811 | A1 | 8/2005 |

* cited by examiner

SEALED PRODUCT DELIVERY UNIT WITH RUPTURING PUMP

This application claims the benefit of provisional application Ser. No. 60/790,483, filed Apr. 10, 2006.

TECHNICAL FIELD

This invention relates to a product delivery unit, and more particularly to a sealed unit with a pump for generating a seal rupturing pressure.

BACKGROUND

Heretofore, medications were packaged in flat packs between a transparent blister cover and a stiff material with a thin foil seal. Multiple medications were presented in a matrix array in a single rectangular pack. The end-user could see the medication through the blister cover, and push the medication down through the base and foil, and out the bottom of the pack. The user had to use enough force to puncture the base material and split through the foil. The pushing force was applied directly on the transparent cover and conveyed down onto the medication. Sometimes the conveyed force crushed the pill, or broke the jacket of a capsule. The medication commonly "hung-up" on the rough edges around the exit puncture. The user had to pick at the exit edges and the medication, causing further damage to the medication. The manual dexterity required for pushing and extracting the medication was frequently difficult for the aged.

SUMMARY

It is therefore an object of this invention to provide a product delivery unit in which no user force or other pushing coercion is applied directly on the product during delivery. The user does not push or force the product out of the unit. The product falls out through a delivery port after the user ruptures the product chamber and clears the port by pulling away a removable port closure. The user applies force directly onto an adjacent pumping chamber to compress air which generates the rupturing pressure.

It is another object of this invention to provide such a sealed delivery unit for medications which does not require touching or handling the medication until after delivery. The medication drops directly into the hand of the end-user or into a dispensing container such as a disposable cup.

It is a further object of this invention to provide such a delivery unit having an opening procedure that is easily understood and executed by the aged, but difficult for young children. Adults can readily survey the physical lay-out of the delivery unit, comprehend the procedure, and press to generate the compressed air. Children on the other hand, go directly for the colored medication and struggle with the hard transparent cover.

It is a further object of this invention to provide such a delivery unit which assists the user in dislodging medications hung-up on the rough exit edges. Compressed air from the pumping chamber supplies an air stream that carries the smooth medication out the exit site.

It is a further object of this invention to provide a medication delivery system having multiple delivery units, in which the disturbance of adjacent non-delivering units is minimized.

Briefly, these and other objects of the present invention are accomplished by providing sealed unit for delivering a product or medication in response to a rupturing pressure. The unit has a generally flat member and an opposed shaped member pressed into selective engagement therewith. A pumping chamber enclosed between the members generates the rupturing pressure in response to an externally applied force. A medication chamber also enclosed contains the medication to be delivered. Fluid communication between the chambers permits rupturing the medication chamber in response to the rupturing pressure. A perimeter seal formed during the selective pressing engagement, extends around the chambers and can withstand the rupturing pressure. A delivery port with a pull-away closure delivers the medication out of the medication chamber. A rupture site proximate the delivery port ruptures outward under the rupturing pressure. A rupture flap produced by the rupturing and connected to the pull-away closure, permits the user to pulling away of the pull-away closure to open the delivery port for delivery of the medication.

BRIEF DESCRIPTION OF THE DRAWINGS

Further objects and advantages of the present delivery unit and the operation of the pumping chamber will become apparent from the following detailed description and drawings (not drawn to scale) in which.

Figure 1A:
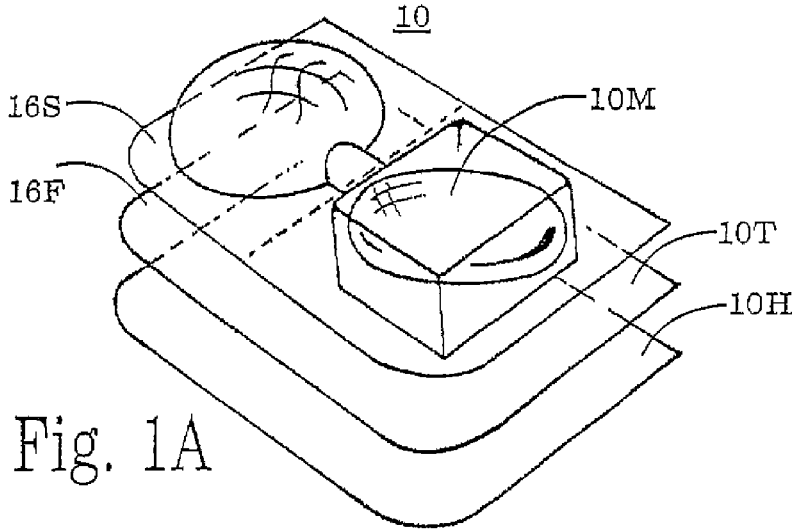
FIG. 1A is an exploded perspective view of delivery unit 10 showing medication chamber 12M and pumping chamber 12P.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

Delivery Unit 10
- Generally Flat Member 10F
- Hermetic Sealing Layer 10H
- Medication 10M
- Shaped Member 10S
- Tough Layer 10T Force Arrow F
- Medication Chamber 12M
- Pumping Chamber 12P Tunnel Conduit 14

Perimeter Seal 16
- Perimeter Lip 16F

Perimeter Lip 16S
Delivery Port 18
Pull-away Closure 18C
Rupture Flap 18F
Rupture Site 18S
Delivery System 20
Divider Perforations 20D
Generally Flat Member 20F
Medication 20M
Shaped Member 20S
Delivery Units 20U
Medication End 21M
Pumping End 21P
Medication Chamber 22M
Pumping Chamber 22P
Tunnel Conduit 24
Medication Exit 24M
Pumping Entrance 24P
Interior Seal 24S
Perimeter Seal 26
Delivery Port 28
Pull-away Closure 28C
Rupture Flap 28F
Rupture Site 28S
Weak Rupture Seal 28W
Spacing S
Delivery System 30
Common Chamber 30C
Medication 30M
Medication Volume 32M
Pumping Volume 32P
Delivery Port 38
Rupturing Site 38S
Delivery Unit 40
Transparent Shaped Member 40S
Medication Chamber 42M
Pumping Chamber 42P
Rupture Flap 48F
Table Top 48T
Push Arrow P
Rupture Arrow R

GENERAL EMBODIMENT (FIG. 1 ABC)

Sealed delivery unit 10 (shown in exploded format in FIG. 1A) contains a small product such as medication 10M. The delivery unit has a generally flat member 10F pressed into selective engagement with an opposed shaped member 10S. A suitable pumping volume, such as chamber 12P, is enclosed between the flat member and the shaped member. The pumping chamber generates a rupturing pressure in response to an external force applied by the user (indicated by arrow F shown in FIG. 1B). The user may be the end-user, (the person who consumes the medication), or a home caretaker or facilitator, or a professional staff person. A suitable product volume, such as medication chamber 12M, is enclosed adjacent to the pumping chamber for containing the medication to be delivered. The two chambers are in fluid communication through tunnel conduit 14, for rupturing the medication chamber in response to the rupturing pressure from the pumping chamber. The tunnel conduit is formed between the flat member and the opposed shaped member by the selective pressing engagement. Perimeter seal 16, formed during the selective pressing engagement, extends around the pumping chamber and the medication chamber and the tunnel conduit. The perimeter seal is secure enough to withstand the internal rupturing pressure generated during delivery. The perimeter seal prevents ambient air and dust from entering the sealed unit and adversely affecting the medication. The perimeter seal may be hermetic for preventing migration of moisture into the unit during long-term storage.

The gas inside the perimeter seal may be any suitable fluid, such as ambient air, dry air, or an inert gas such as nitrogen. Delivery port 18 with pull-away closure 18C (see FIG. 1C) delivers medication 10M out of medication chamber 12M. Rupture site 18S is proximate the delivery port. Rupture flap 18F produced by the rupturing at the rupture site, is connected to the pull-away closure. The flap projects outward permitting the user to grasp the pull-away the closure and open the delivery port for delivery of the medication. The shaped member is preferable transparent, permitting the user to visually identify the medication before rupturing and delivery. Perimeter lip 16F may extend along the perimeter of the flat member (as shown in exploded view FIG. 1A), and opposed perimeter lip 16S may extend along the perimeter of the shaped member. The opposed perimeter lips form the perimeter seal around the pumping chamber and the medication chamber.

Shaped member 10S may be of any suitable material such as PVC or PET for protecting the medications. Flat member 10F may have multiple layers to provide strength and enclosure. Tough layer 10T, pressed against the shaped layer, may be of any suitable resistant material such as polyethylene. Hermetic layer 10H, pressed against the tough layer, may be any suitable sealing material such as a metal foil.

Figure 1B:
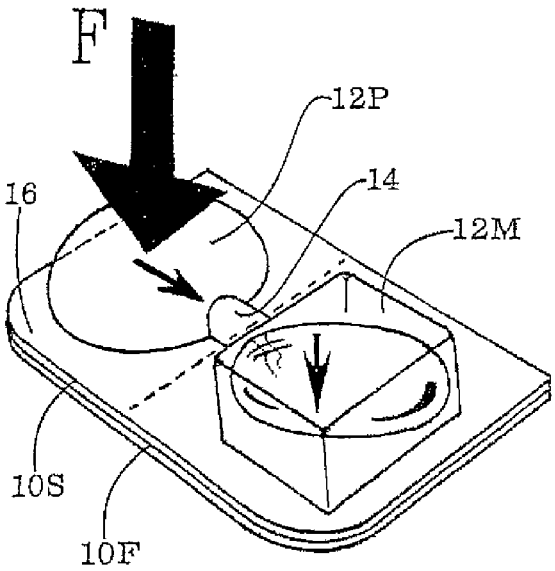
FIG. 1B is a perspective view of delivery unit 10 of FIG. 1A, showing external pressure applied to pumping chamber 12P.
Figure 1C:
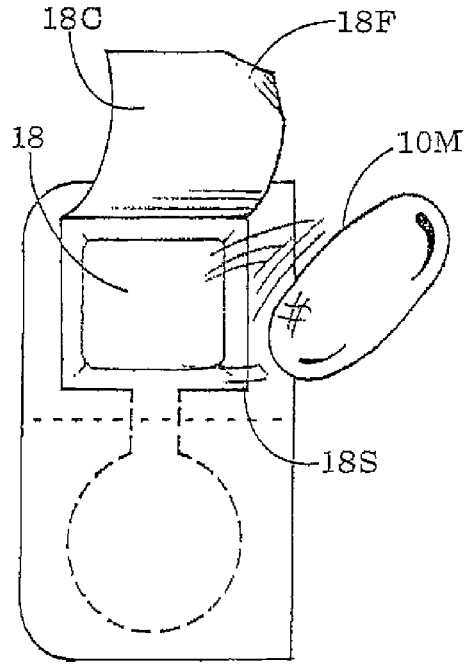
FIG. 1C is a perspective view of the back side of delivery unit 10 of FIG. 1A showing open delivery port 18 and pull-away closure 18C with medication 10M exiting from medication chamber 12M.
Figure 2A:
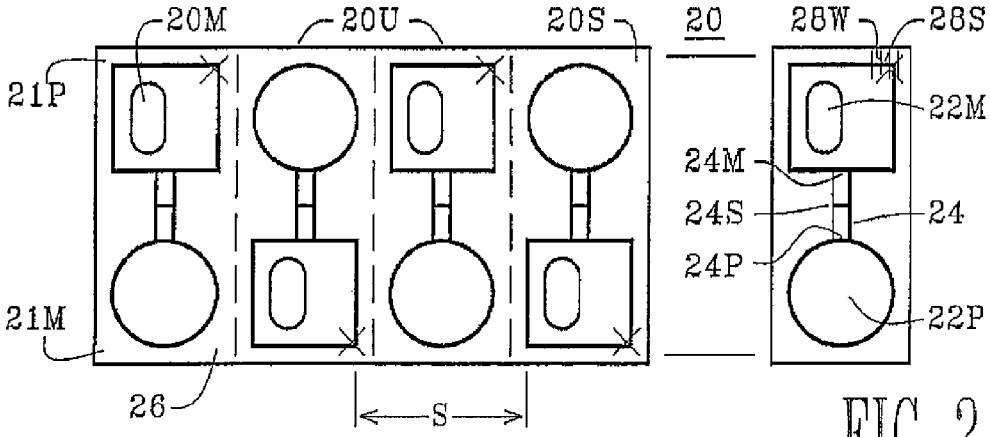
FIG. 2A is a front view of delivery system 20 having multiple delivery units 20U, each with a medication chamber 22M and a pumping chamber 22P.
Figure 2B:
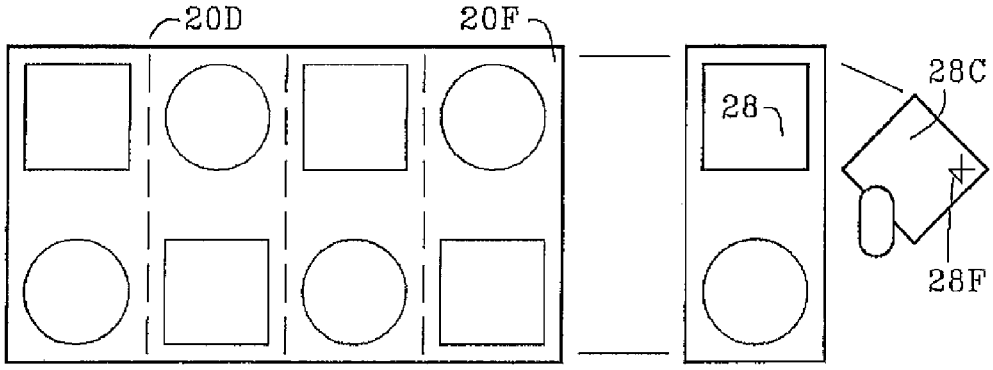
FIG. 2B is a back view of delivery system 20 of FIG. 2A showing multiple delivery ports 28.

The delivery port may be in the flat member (as shown in FIG. 1C). Rupture site 18S may be a suitable cusp or rift in the flat member, such as a score made by a laser beam or a mechanical scratching edge. Preferably, the penetration of the score into the material of the flat member is deep enough to weaken the flat member, but not so deep as to cause-breaching of the sealed unit. The rift score must be sufficiently frail to blow-out under rupturing pressure, and sufficiently secure to maintain the sealed closure. Rupture flap 18F may be a tab or a triangular piece of flat member material over the rupture site. Pull-away closure 18C of the delivery port may be defined by a tear-away border in the flat member. The tear-away border may have three side as shown in FIG. 1C, with the fourth side remaining attached to the flat member. In the embodiment of FIG. 2B, the tear-away border is annular with four sides as shown in FIG. 2B, and pull-away closure 28C is completely removable. The tear-away border and pull-away closure may be various shaped and sizes, so long as the medication can pass through the delivery port. The tear-away border may be a series of weakening perforations or dents part-way through the flat member. Alternatively, the tear-away border may be a score in the flat member, similar to the rupture score.

MULTIPLE UNITS EMBODIMENT (FIGS. 2AB)

Sealed delivery system 20 has a plurality of delivery units 20U enclosed between shaped member 20S (see front view FIG. 2A) and flat member 20F (see back view FIG. 2B). Each unit has pumping chamber 22P and medication chamber 22M with conduit 24 providing fluid communication therebetween. Perimeter seal 26 extends around the delivery units for sealing the pumping chambers and the medication chambers. Each unit has a delivery port 28 on the back with a pull-away closure 28C with rupture flap 28F. In the embodiment of FIG. 2, rupture site 28S is an "X" shaped score on the perimeter seal and near the border of closure 28C. A weak rupture seal 28W (indicated by single hatching lines) may be employed proximate each rupture site. The rupture seal is a weak bond between shaped member 20S and flat member 20F, which has been pretreated prior to the pressing engagement to reduce the strength of the perimeter seal at the rupture site. During the pumping cycle, the pumping pressure builds-up within the product chamber. The pressure slips through the rupture seal and blows open at the rupture site, producing the rupture flaps.

In delivery system 20, each delivery unit 20U is elongated with a pumping end 21P for the pumping chamber and a medication end 21M for the medication chamber. The delivery units are arranged adjacently side-by-side with the pumping chamber of each delivery unit next to the medication chamber of the adjacent delivery unit in alternating sequence. The units are preferable separated by divider score or perforations 20D.

The pumping chambers may be dome-shaped (as shown in FIG. 1A) for easy compression by the user to generate the rupturing pressure. The domes yield and collapse, displacing air through the tunnel conduit. The medication chambers may be cube-like, with rigid sidewalls, which do not crush or buckle as easily as the domes. The side walls provide spaced barriers between alternate domed pumping chambers (indicated by Spacing S in FIG. 2A). The spacing is wide enough for the user's thumb or finger, or for a small pressing instrument. The barriers prevent the user from pressing or disturbing more than one dome in a single compression cycle. The domes may be sufficiently resilient to return to the original dome-shape after compression, and refill for providing another rush of air. The user may repump the dome to assist in dislodging medications hung-up on the rough tear-away edges of the delivery port.

Tunnel conduit 24 has a pumping entrance 24P opening from the pumping chamber, and a medication exit 24M opening into the medication chamber. The conduit provides fluid communication from the pumping chamber into the medication chamber. Interior seal 24S may be employed to seal off the tunnel conduit, sealing-off the medication chamber from the pumping chamber. The interior seal blocks the fluid communication during shipping and storage of the sealed unit, or other periods of non-use. The interior seal bursts under the rupturing pressure, restoring fluid communication just prior to delivery. Some medications require an environmentally protected volume with a critical sealed perimeter. Small volumes present less internal air interface with the medication, and short perimeters have less possibility of failure and contamination. The interior seal isolates the medication from the air in the pumping chamber and from the effects of leakage in the perimeter seal around the pumping chamber. Pumping chamber 22P is out of fluid communication with medication chamber 22M until the rupturing pressure disables or removes the interior seal.

COMMON CHAMBER EMBODIMENT (FIG. 3)

Figure 3:
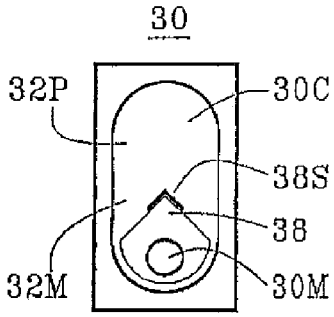
FIG. 3 is a plan view of delivery unit 30 with medication 30M and rupturing site 38S within common chamber 30C.

Delivery unit 30 has a common chamber 30C with pumping volume 32P at one end and medication volume 32M at the other end. Applying pressure to the pumping volume causes the rift over rupture site 38S in the medication end to blow-out. The common chamber embodiment does not have a tunnel conduit. The pump and medication are in fluid communication due to the common chamber. The rift may be an "L" shaped score (shown in bold in FIG. 3) at a corner location of delivery port 38.

COPLANAR EMBODIMENT (FIG. 4)

Figure 4:
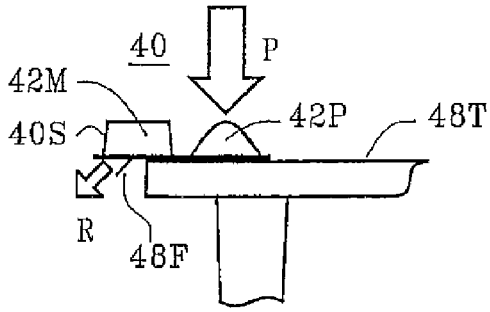
FIG. 4 is a side view of coplanar delivery unit 40 being opened on a flat surface.

The flat member and the opposed perimeter lips may be coplanar defining a stable working plane for opening the delivery unit. Coplanar delivery unit 40 may be placed near the edge of flat counter or table top 48T (see FIG. 4), with pumping chamber 42P firmly settled against the table top and medication chamber 42M overhanging the edge. At least the rift portion of the medication chamber extends beyond the table edge. The plane of the table top offers a firm, level surface for receiving and supporting the planar side of the delivery unit. The user presses down on pumping chamber 42P against the table top (indicated by arrow P) causing rupture flap 48F to blow open downward (indicated by arrow R).

Applying pressure P at one end of the unit to get a rupture event R at the other end is an "indirection" not evident to a child. A wayward child will see the brightly colored medication through transparent, rigid shaped member 40S, and instantly focuses on the "candy-like" object.

INDUSTRIAL APPLICABILITY

It will be apparent to those skilled in the art that the objects of this invention have been achieved as described hereinbefore by providing a product delivery unit in which the user does not apply force or other pushing coercion directly on the medication. The medication chamber ruptures and the product drops out through a delivery port in response to compressed air. The medications is not require touched until after delivery. The opening procedure that is readily understood by adults, but opaque and indirect to for young children. The compressed air assists the user in removing medications stuck in the delivery port. The medications may be delivered without disturbing adjacent non-delivered medications.

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

I claim:

1. A sealed unit for delivering a product in response to a rupturing pressure, comprising:

a generally flat member;

a shaped member opposed to the flat member, and pressed into selective engagement with the flat member;

a pumping volume enclosed between the flat member and the opposed shaped member for generating the rupturing pressure in response to an externally applied force;

a product volume enclosed between the flat member and the opposed shaped member for containing the product to be delivered;

fluid communication between the pumping volume and the product volume permits the rupturing the product volume in response to the rupturing pressure from the pumping volume;

a product contained in the product volume;

a perimeter seal formed during the selective pressing engagement, and extending around the pumping volume and the product volume, which perimeter seal can withstand the rupturing pressure;

a delivery port with a pull-away closure for delivering the product out of the product volume;

a rupture site proximate the delivery port which ruptures outward under the rupturing pressure; and a rupture flap produced by the rupturing at the rupture site, and connected to the pull-away closure, permitting pulling away of the pull-away closure to open the delivery port for delivery of the product contained within the product volume.

2. The delivery unit of claim 1, wherein the sealed pumping volume is a pumping chamber, and the sealed product volume is a product chamber.

3. The delivery unit of claim 2, further comprising:

a tunnel conduit within the perimeter seal, formed between the flat member and the opposed shaped member by the selective pressing engagement, having a pumping entrance opening from the pumping chamber and a product exit opening into the product chamber, and providing the fluid communication from the pumping chamber into the product chamber.

4. The delivery unit of claim 3, further comprising:

an interior seal for sealing-off the tunnel conduit between the product chamber and the pumping chamber, which interior seal fails under the rupturing pressure.

5. The delivery unit of claim 1, further comprising a perimeter lip around the flat member;

an opposed perimeter lip around the shaped member;

which perimeter lips form the perimeter seal around the pumping volume and the product volume during the selective pressing engagement.

6. The delivery unit of claim 5, wherein the perimeter seal is hermetic.

7. The delivery unit of claim 5, wherein the flat member and the perimeter lips are coplanar.

8. The delivery unit of claim 1, wherein the flat member further comprises:

a tough layer pressed against the shaped layer; and a hermetic foil layer pressed against the tough layer.

9. The delivery unit of claim 1, wherein the delivery port out of the sealed product volume is through the flat member, and the rupture site is a rift in the flat member.

10. The delivery unit of claim 9, wherein the rupture site rift is a score in the flat member.

11. The delivery unit of claim 9, further comprising:

a rupture seal forming a weak section of the perimeter seal at the rupture site, which cannot withstand the rupturing pressure and causes the rupturing of the rupture flap.

12. The delivery unit of claim 9, wherein the rupture flap is a triangular piece of the flat member covering at the rupture site.

13. The delivery unit of claim 9, wherein the pull-away closure of the delivery port is defined by a tear-away border within the perimeter seal around the product volume.

14. The delivery unit of claim 13, wherein the tear-away border is a series of perforations in the flat member.

15. The delivery unit of claim 13, wherein the tear-away border is a score in the flat member.

16. A sealed system for delivering medications in response to a rupturing pressure, comprising:

a flat member;

a shaped member opposed to the flat member, and pressed into selective engagement with the flat member;

a plurality of delivery units enclosed between the flat member and the opposed shaped member;

a pumping chamber within each delivery unit for generating the rupturing pressure;

a medication chamber within each delivery unit for containing the medication to be delivered;

fluid communication between the pumping chamber and the medication chamber, for communicating the rupturing pressure from that pumping chamber to the medication chamber;

a medication contained in each medication chamber;

a perimeter seal formed during the selective pressing engagement to withstand the rupturing pressure, and extending around the delivery units for sealing the pumping chambers and the medication chambers;

a delivery port with a pull-away closure out of each medication chamber for delivering the medications in the sealed medication chambers;

a rupture site proximate each delivery port which ruptures outward under the rupturing pressure; and a rupture flap produced by the rupturing of the rupture site, and connected to the pull-away closure, permitting pulling away of the pull-away closure to open the delivery port for delivery of the medication contained in the medication chambers.

17. The sealed delivery system of claim 16, wherein each delivery unit is elongated with a pumping end for the pumping chamber and a medication end for the medication chamber; and the delivery units are arranged adjacently side-by-side with the pumping chamber of each delivery unit next to the medication chamber of the adjacent delivery unit in alternating sequence.

18. The sealed delivery system of claim 17, wherein:

the pumping chambers are dome-shaped for easy compression under the rupturing pressure; and the medication chambers have rigid sidewalls for providing spaced barriers between alternate pumping chambers.

19. The sealed delivery system of claim 18, wherein the barrier spacing is wide enough to permit applying an external force to the pumping chamber for generating the rupturing pressure.

20. The sealed delivery system of claim 18, wherein the dome-shaped pumping chambers may be sufficiently resilient to regain the dome-shape after compression.

* * * * *